US012584649B2

(12) United States Patent
Yamaguchi

(10) Patent No.: US 12,584,649 B2
(45) Date of Patent: Mar. 24, 2026

(54) AIR CONDITIONER SYSTEM AND CONTROL METHOD

(71) Applicant: Mitsubishi Electric Corporation, Tokyo (JP)

(72) Inventor: Koji Yamaguchi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 414 days.

(21) Appl. No.: 18/245,362

(22) PCT Filed: Feb. 5, 2021

(86) PCT No.: PCT/JP2021/004397

§ 371 (c)(1),
(2) Date: Mar. 15, 2023

(87) PCT Pub. No.: WO2022/168278

PCT Pub. Date: Aug. 11, 2022

(65) Prior Publication Data

US 2023/0332795 A1 Oct. 19, 2023

(51) Int. Cl.
*G06F 3/048* (2013.01)
*F24F 11/63* (2018.01)

(52) U.S. Cl.
CPC ..... *F24F 11/63* (2018.01)

(58) Field of Classification Search
CPC .. F24F 11/63; F24F 3/065; F24F 11/49; F24F 11/56; F24F 11/62; F24F 11/54
See application file for complete search history.

(56) References Cited

U.S. PATENT DOCUMENTS 5,435,147 A 7/1995 Mochizuki et al.
2011/0127341 A1* 6/2011 Kaneoya ..... F24F 11/62 62/238.7
2019/0346166 A1 11/2019 Koizumi et al.

FOREIGN PATENT DOCUMENTS

CN 110199159 A 9/2019
EP 3 406 984 A1 11/2018
JP F06-241544 A 8/1994
JP 2008-241165 A 10/2008
(Continued)

OTHER PUBLICATIONS

International Search Report of the International Searching Authority issued Apr. 20, 2021 in corresponding International Patent Application No. PCT/JP2021/004397 (with English translation).
(Continued)

*Primary Examiner* — Aleksey Olshannikov
(74) *Attorney, Agent, or Firm* — Posz Law Group, PLC

(57) ABSTRACT

An air conditioner system has an outdoor unit and indoor units connected via a communication line. The air conditioner system includes a communication unit that communicates with an external device and one of the indoor units; and a communication control unit. As information for identifying each of the outdoor unit and the indoor units, the control unit associates first identification information uniquely set to each of the outdoor unit and the indoor units with second identification information uniquely set to the communication unit, and transmits the associated information from the one indoor unit to the external device via the communication unit.

14 Claims, 8 Drawing Sheets

(56) References Cited

FOREIGN PATENT DOCUMENTS

| | | | |
|---|---|---|---|
| JP | 2009-085513 | A | 4/2009 |
| JP | 2011-112298 | A | 6/2011 |
| JP | 2014-194309 | A | 10/2014 |
| JP | 2015-124901 | A | 7/2015 |
| JP | 2019-020033 | A | 2/2019 |

OTHER PUBLICATIONS

Office Action dated Nov. 28, 2023 issued in corresponding JP patent application No. 2022-579274 (and English translation).
Chinese Office Action mailed May 31, 2025 in corresponding Chinese Office Action No. 202180071847.7 (and English machine translation).

* cited by examiner

FIG. 3

| | |
|---|---|
| OPERATING STATE INFORMATION OF OUTDOOR UNIT 10 | ID31, ID11, OPERATING, INTERNAL TEMPERATURE, EXTERNAL AIR TEMPERATURE, ··· |
| OPERATING STATE INFORMATION OF INDOOR UNIT 20a | ID31, ID21, OPERATING, COOLING, SET TEMPERATURE, INTERNAL TEMPERATURE, ROOM TEMPERATURE, ··· |
| OPERATING STATE INFORMATION OF INDOOR UNIT 20b | ID31, ID22, OPERATING, COOLING, SET TEMPERATURE、INTERNAL TEMPERATURE, ROOM TEMPERATURE, ··· |
| OPERATING STATE INFORMATION OF INDOOR UNIT 20c | ID31, ID23, OPERATING, COOLING, SET TEMPERATURE, INTERNAL TEMPERATURE, ROOM TEMPERATURE, ··· |

FIG. 4

| | |
|---|---|
| OPERATION INSTRUCTION INFORMATION FOR INDOOR UNIT 20a | ID31, ID21, OPERATION DETAILS INFORMATION |
| OPERATION INSTRUCTION INFORMATION FOR INDOOR UNIT 20b | ID31, ID22, OPERATION DETAILS INFORMATION |
| OPERATION INSTRUCTION INFORMATION FOR INDOOR UNIT 20c | ID31, ID23, OPERATION DETAILS INFORMATION |

AIR CONDITIONER SYSTEM AND CONTROL METHOD

CROSS-REFERENCE TO RELATED APPLICATION

This application is a U.S. National Stage Application of International Application No. PCT/JP2021/004397 filed on Feb. 5, 2021, the contents of which are incorporated herein by reference.

TECHNICAL FIELD

The present disclosure relates to an air conditioner system and a control method.

BACKGROUND

In an air conditioner system in which a plurality of indoor units are connected to one outdoor unit (hereinafter referred to as "air conditioner"), there is a technique in which each device communicates with an external server and an external terminal via a communication unit (for example, a network adapter) provided for each device in order to give operation instructions on operations of the indoor units and the outdoor unit and monitor operating states of the indoor units and the outdoor unit, using the external server and the external operation terminal (see, for example, Patent Document 1).

Further, in an air conditioner system in which a plurality of indoor units are connected to each of a plurality of outdoor units, there is a technique in which a predetermined one of the plurality of indoor units is connected to each outdoor unit, instead of a communication unit being provided for each indoor unit, and communicates with an external server and an external terminal via one communication unit to collectively manage information of each device (see, for example, Patent Document 2).

PATENT LITERATURE

[Patent Document 1] Japanese Patent Application Publication No. 2015-124901

[Patent Document 2] Japanese Patent Application Publication No. 2019-020033

In the technique described in Patent Document 1, however, it is necessary to provide a communication unit for each device, thereby complicating communication processing and increasing costs. Further, in the technique described in Patent Document 2, although it is not necessary to provide a communication unit for each indoor unit, information of each of the plurality of outdoor units and the plurality of indoor units is sent via one communication unit, thereby requiring that a user register each device using an external terminal or the like in order to collectively manage the information of each device. Moreover, there have been cases where even if each device is registered, the user could not easily know which indoor unit is connected to which outdoor unit.

The present disclosure has been made in view of the above circumstances, and one object thereof is to provide an air conditioner system in which a plurality of indoor units are connected to one outdoor unit, and which makes it possible to collectively manage each device easily with a simple configuration.

SUMMARY

The present disclosure has been made to solve the problems described above, an air conditioner system according to an aspect of the present disclosure is an air conditioner system in which an outdoor unit and a plurality of indoor units are connected via a communication line, and the an air conditioner system includes: a communication unit configured to communicate with an external device and one indoor unit of the plurality of indoor units; and a communication control unit configured to, as information for identifying each of the outdoor unit and the plurality of indoor units, associate first identification information uniquely set to each of the outdoor unit and the plurality of indoor units with second identification information uniquely set to the communication unit, and transmit from the one indoor unit the associated information to the external device via the communication unit.

A control method according to another aspect of the present disclosure is a control method for one indoor unit of a plurality of indoor units connected with an outdoor unit via a communication line in an air conditioner system. The control method includes: communicating with an external device via a communication unit; as information for identifying each of the outdoor unit and the plurality of indoor units, associating first identification information uniquely set to each of the outdoor unit and the plurality of indoor units with second identification information uniquely set to the communication unit; and transmitting the associated information from the one indoor unit to the external device via the communication unit.

According to the above aspect of the present disclosure, the air conditioner system in which the plurality of indoor units are connected to the one outdoor unit can collectively manage each device easily with a simple configuration.

BRIEF DESCRIPTION OF THE DRAWINGS

FIG. 3 is a diagram showing an example of information to be transmitted from the indoor unit according to the first embodiment to an external operation terminal.

FIG. 4 is a diagram showing an example of operation instruction information according to the first embodiment.

DETAILED DESCRIPTION

Hereinafter, embodiments of the present disclosure will be described with reference to the drawings.

First Embodiment

First, a first embodiment of the present disclosure will be described.

(System Configuration)

Figure 1:
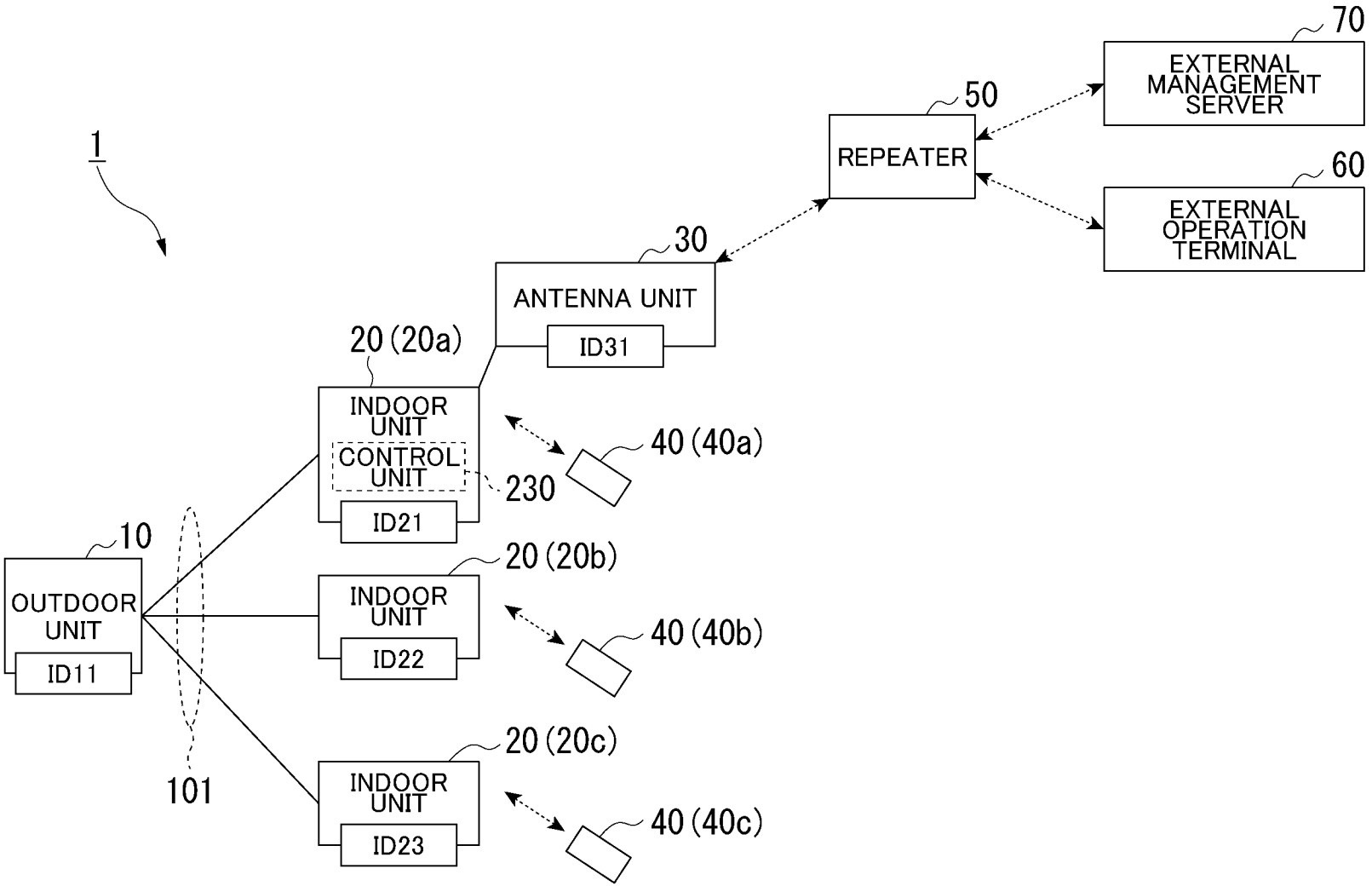
FIG. 1 is a system diagram showing an example of an air conditioner system according to a first embodiment.

FIG. 1 is a system diagram showing an example of an air conditioner system according to the present embodiment. An air conditioner system 1 is a multi-type air conditioner (air conditioner) system in which a plurality of indoor units 20 are connected to one outdoor unit 10. For example, the illustrated air conditioner system 1 includes one outdoor unit 10 installed outside a building, three indoor units 20 (20*a*, 20*b*, 20*c*) installed inside the building, an antenna unit 30, and remote controllers 40 (40*a*, 40*b*, 40*c*) corresponding respectively to the three indoor units 20. As an example, in a multi-story building, one outdoor unit 10 is installed for each floor, one indoor unit 20 is installed for each room on each floor, and a plurality of (here, three) indoor units 20 are connected to one outdoor unit 10 installed on the same floor.

In the following description, the indoor units 20*a*, 20*b*, and 20*c* will be referred to as the indoor units 20 unless otherwise distinguished from one another. Similarly, the remote controllers 40*a*, 40*b*, and 40*c* will be referred to as remote controllers 40 unless otherwise distinguished from one another. Additionally, a quantity of indoor units 20 connected to one outdoor unit 10 is not limited to three, and may be arbitrary.

The outdoor unit 10 is a device that functions as an outdoor unit for each of the indoor units 20*a*, 20*b*, and 20*c*. Each of the indoor unit 20*a*, the indoor unit 20*b*, and the indoor unit 20*c* is communicatively connected to the outdoor unit 10 via a communication line 101. The communication line 101 is a wired communication line. For example, the communication line 101 to communicatively connect the outdoor unit 10 and the indoor unit 20*a* is wired along a piping route between the outdoor unit 10 and the indoor unit 20*a*. The communication line 101 to communicatively connect the outdoor unit 10 and the indoor unit 20*b* is wired along a piping route between the outdoor unit 10 and the indoor unit 20*b*. The communication line 101 to communicatively connect the outdoor unit 10 and the indoor unit 20*c* is wired along a piping route between the outdoor unit 10 and the indoor unit 20*c*.

The remote controller 40 is a remote controller that communicates with the indoor unit 20 using infrared rays. For example, the remote controller 40 outputs an operation instruction signal including operation details to the indoor unit 20 by infrared rays. The operation details given to the indoor unit 20 include, for example, operations to start and stop operation, an operation to switch among cooling operation, heating operation, and ventilating operation, an operation to set the set temperature, an operation to set an air volume, and the like. The indoor unit 20 receives an operation instruction signal output from the remote controller 40 and controls the operation based on the operation details included in the received operation instruction signal. In the illustrated example, the remote controllers 40*a*, 40*b*, and 40*c* are remote controllers for operating indoor units 20*a*, 20*b*, and 20*c*, respectively. Here, the remote controller 40 and the indoor unit 20 may communicate with each other via a communication line.

The antenna unit 30 is connected to the indoor unit 20*a*. The antenna unit 30 is an example of a communication unit for the indoor unit 20*a* and an external operation terminal 60 to communicate with each other via a repeater 50. For example, the antenna unit 30 is a communication device including an antenna for wirelessly connecting to a LAN (Local Area Network) provided in the building. The repeater 50 is, for example, a wireless LAN router that communicatively connects the LAN in the building and a public line, such as the Internet or a mobile phone communication network. The indoor unit 20*a* and the external operation terminal 60 can communicate with each other by connecting to the wireless LAN via the repeater 50.

The external operation terminal 60 is, for example, a terminal operated by a user, such as a smart phone or a tablet terminal. The external operation terminal 60 acquires information stored by each device of the outdoor unit 10 and the indoor units 20, and collectively manages the acquired information. The information stored by each device of the outdoor unit 10 and the indoor units 20 is, for example, information regarding an operating state of each device. The information regarding the operating state includes information indicating an operating state such as operating or stopped, information indicating an operating mode such as cooling, heating, or ventilating, setting information such as a set temperature and an air volume, detection information such as a room temperature, an outside temperature, or an internal temperature, and the like. The external operation terminal 60 periodically acquires information regarding an operating state from each device, and displays the operating state of each device.

Specifically, the external operation terminal 60 acquires information regarding an operating state of each device via the repeater 50 from the indoor unit 20*a* connected with the antenna unit 30. Here, each of the outdoor unit 10, the indoor units 20, and the antenna unit 30 is set with unique identification information. In the example shown in FIG. 1, it is assumed that the identification information of the outdoor unit 10 is set to "ID11," the identification information of the indoor unit 20*a* is set to "ID21," the identification information of the indoor unit 20*b* is set to "ID22," the identification information of the indoor unit 20*c* is set to "ID23," and the identification information of the antenna unit 30 is set to "ID31."

The indoor unit 20*a* includes a control unit 230 configured to associate the identification information uniquely set to each of the outdoor unit 10 and the indoor units with the identification information uniquely set to the antenna unit 30 and transmit the associated information to the external operation terminal 60 via the antenna unit 30 and the repeater 50. For example, the control unit 230 associates information regarding an operating state of the indoor unit 20*a* with "ID21" and "ID31," and transmits the associated information to the external operation terminal 60. Further, the control unit 230 acquires via the communication line 101 and the outdoor unit 10, information regarding an operating state of the indoor unit 20*b* which is associated with "ID22," associates the acquired information regarding the operating state with "ID22" and "ID31," and transmits the associated information to the external operation terminal 60. Further, the control unit 230 acquires via the communication line 101 and the outdoor unit 10, information regarding an operating state of the indoor unit 20*c* which is associated with "ID23," associates the acquired information regarding the operating state with "ID23" and "ID31," and transmits the associated information to the external operation terminal 60. Further, the control unit 230 acquires via the communication line 101, information regarding an operating state of the outdoor unit 10 which is associated with "ID11," associates the acquired information regarding the operating state with "ID11" and "ID31," and transmits the associated information to the external operation terminal 60. As a result, by communicating only with the indoor unit 20*a*, the external operation terminal 60 can acquire and monitor information regarding an operating state of each of the outdoor unit 10 and the plurality of indoor units 20 so that the information for each device is distinguishable from one another.

Setting of identification information in each device may be a hardware setting such as a setting by a slide switch provided in each device, or a software setting such that a setting is stored in a memory (storage unit) provided in each device by a setting operation or the like using the remote control 40. Further, the identification information can be arbitrarily changed by the above hardware setting or software setting.

Further, by using the identification information uniquely set to each of the outdoor unit 10 and the indoor units 20 and the identification information uniquely set to the antenna unit 30, the external operation terminal 60 can collectively give operation instructions on operations for the respective devices. Thus, the external operation terminal 60 can collectively manage each of the outdoor unit 10 and the plurality of indoor units 20 by communicating only with the indoor unit 20*a*.

Here, the external operation terminal 60 can be communicatively connected to the indoor unit 20*a* from outside the building. In that case, the repeater 50 includes a communication base station or the like for public lines, in addition to the wireless LAN router. In other words, the external operation terminal 60 can collectively manage each of the outdoor unit 10 and the plurality of indoor units 20 from outside the building as well as within a communicatively connectable range of the LAN inside the building.

Further, in lieu of, or in addition to, the external operation terminal 60, an external management server 70 can be communicatively connected to the indoor unit 20*a* via the repeater 50. For example, the external management server 70 may be a cloud server. By communicating only with the indoor unit 20*a*, the external management server 70 can acquire and monitor information regarding an operating state of each of the outdoor unit 10 and the plurality of indoor units 20 so that the information for each device is distinguishable from one another.

Further, by using the identification information uniquely set to each of the outdoor unit 10 and the indoor units 20 and the identification information uniquely set to the antenna unit 30, the external management server 70 may give operation instructions on operations for the respective devices and perform an automatic operation control or the like. Further, the external management server 70 may collectively manage not only the air conditioner system 1, but also electrical equipment other than the air conditioner system 1.

Next, a configuration of each device included in the air conditioner system 1 will be described in detail.

Figure 2:
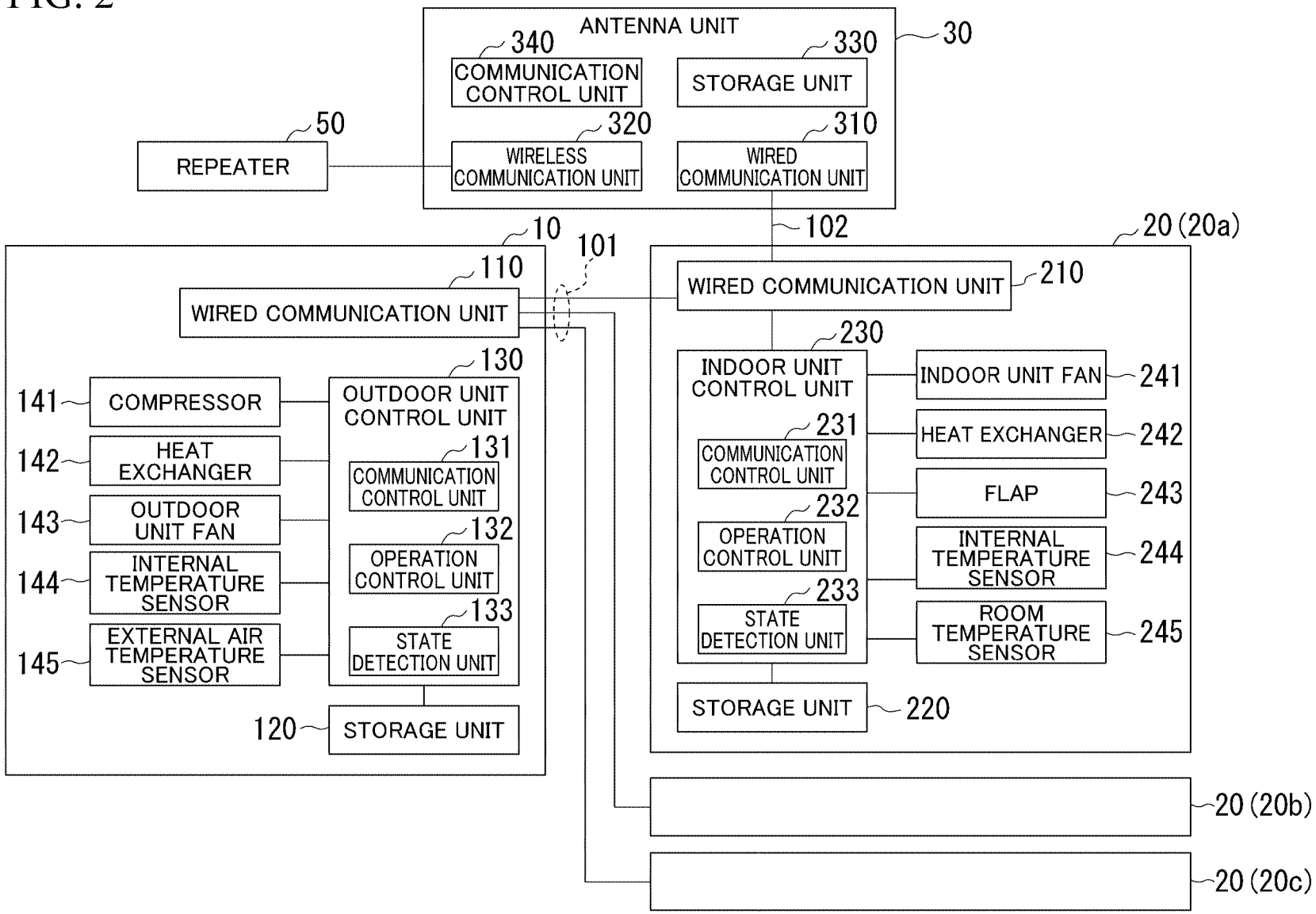
FIG. 2 is a block diagram showing an example of configurations of an outdoor unit, an indoor unit, and an antenna unit according to the first embodiment.

FIG. 2 is a block diagram showing an example of configurations of the outdoor unit 10, the indoor unit 20, and the antenna unit 30 according to the present embodiment.

(Configuration of Outdoor Unit 10)

The outdoor unit 10 shown in FIG. 2 includes a wired communication unit 110, a storage unit 120, an outdoor unit control unit 130, a compressor 141, a heat exchanger 142, an outdoor unit fan 143, an internal temperature sensor 144, and an external air temperature sensor 145.

The wired communication unit 110 is configured to include a communication device for communicating with each indoor unit 20. The wired communication unit 110 is connected to each indoor unit 20 via the communication line 101. A storage unit 120 stores a control program for controlling operation of the outdoor unit 10, and the like. Further, the storage unit 120 stores the identification information (for example, "ID11") and information regarding an operating state of the outdoor unit 10, information acquired from each indoor unit 20, and the like. The information acquired from each indoor unit includes the identification information and information regarding an operating state of each indoor unit 20, and the like.

An outdoor unit control unit 130 controls each unit included in the outdoor unit 10. For example, the outdoor unit control unit 130 includes a CPU (Central Processing Unit), a memory, and the like. The outdoor unit control unit 130 includes a communication control unit 131, an operation control unit 132, and a state detection unit 133, as functional configurations realized by executing the control program stored in the storage unit 120.

The communication control unit 131 controls communication with each of the indoor units 20*a*, 20*b*, and 20*c* via the wired communication unit 110 and the communication line 101. For example, the communication control unit 131 acquires from each of the indoor units 20*a*, 20*b*, and 20*c*, information regarding an operating state of a respective one of the indoor units 20*a*, 20*b*, and 20*c*. For example, the communication control unit 131 acquires information in which the identification information and information regarding an operating state of each of the indoor units 20*a*, 20*b*, and 20*c* are associated with each other, and causes the storage unit 120 to store the acquired information. Specifically, the communication control unit 131 periodically acquires the information in which the identification information and information regarding an operating state are associated with each other, and causes the storage unit 120 to store the acquired information.

Further, the communication control unit 131 transmits to the indoor unit 20*a*, the information in which the identification information and information regarding an operating state of each indoor unit 20 are associated with each other, which is stored in the storage unit 120. Further, the communication control unit 131 transmits to the indoor unit 20*a*, the information in which the identification information and information regarding an operating state of the outdoor unit 10 are associated with each other.

Here, the communication control unit 131 may acquire information in which the identification information and information regarding an operating state of each of at least the indoor units 20*b* and 20*c* are associated with each other, and cause the storage unit 120 to store the acquired information. Then, the communication control unit 131 may transmit to the indoor unit 20*a*, the information in which the identification information and information regarding an operating state of each of the indoor units 20*b* and 20*c* are associated with each other, which is stored in the storage unit 120. This is because the indoor unit 20*a* originally stores information in which the identification information and information regarding an operating state of the indoor unit 20*a* are associated with each other.

The operation control unit 132 controls operation of the outdoor unit 10. For example, the operation control unit 132 controls operation of the outdoor unit 10 based on the information regarding an operating state of each of the indoor units 20*a*, 20*b*, and 20*c* acquired from a respective one of the indoor units 20*a*, 20*b*, and 20*c*. Specifically, the operation control unit 132 controls operations of the compressor 141, the outdoor unit fan 143, and the like.

The state detection unit 133 detects a state of each unit of the outdoor unit 10. For example, the state detection unit 133 periodically detects an operating state (operating, stopped, or the like) of the outdoor unit 10 controlled by the operation control unit 132. Further, the state detection unit 133 periodically detects an internal temperature and an external air temperature based on sensor outputs of the internal temperature sensor 144 and the external air temperature sensor 145. The internal temperature sensor 144 is a temperature sensor provided inside the outdoor unit 10 to detect a temperature inside the outdoor unit 10. For example, the internal temperature sensor 144 detects a temperature of the heat exchanger 142 or the like. The external air temperature sensor 145 is a temperature sensor provided in the outdoor unit 10 to detect an external air temperature. The state detection unit 133 causes the storage unit 120 to store information such as the detected operating state, internal temperature, and external air temperature, as the information regarding an operating state.

(Configuration of Indoor Unit 20)

Next, a configuration of the indoor unit 20 will be described. A basic configuration of each of the indoor units 20*a*, 20*b*, and 20*c* is the same, and the difference is that only the indoor unit 20*a* is connected to the antenna unit 30. In FIG. 2, the configuration of the indoor unit 20*a* is shown as an example, and the configurations of the indoor units 20*b* and 20*c* are omitted. The indoor unit 20 (20*a*) includes a wired communication unit 210, a storage unit 220, an indoor unit control unit 230, an indoor unit fan 241, a heat exchanger 242, a flap 243, an internal temperature sensor 244, and a room temperature sensor 245.

The wired communication unit 210 is configured to include a communication device for communicating with the outdoor unit 10. The wired communication unit 210 is connected to the outdoor unit 10 via the communication line 101. The wired communication unit 210 of the indoor unit 20*a* is further connected to the antenna unit 30 via a communication line 102 and communicates with the antenna unit 30 as well.

The storage unit 220 stores a control program for controlling operation of the indoor unit 20, and the like. Further, the storage unit 220 stores the identification information and information regarding an operating state of the indoor unit 20.

For example, the storage unit 220 of the indoor unit 20*a* stores the identification information ("ID21") and information regarding an operating state of the indoor unit 20*a*. Further, the storage unit 220 of the indoor unit 20*a* further stores the identification information ("ID11") and information regarding an operating state of the outdoor unit 10, which are acquired from the outdoor unit 10, and the identification information ("ID22," "ID23") and information regarding operating states of the other indoor units 20*b* and 20*c*, which are acquired via the outdoor unit 10.

Similarly, the storage unit 220 of the indoor unit 20*b* stores the identification information ("ID22") and information regarding an operating state of the indoor unit 20*b*, the identification information ("ID11") and information regarding an operating state of the outdoor unit 10, and the identification information ("ID21," "ID23") and information regarding operating states of the other indoor units 20*a* and 20*c*. The storage unit 220 of the indoor unit 20*c* stores the identification information ("ID23") and information regarding an operating state of the indoor unit 20*c*, the identification information ("ID11") and information regarding an operating state of the outdoor unit 10, and the identification information ("ID21," "ID22") and information regarding operating states of the other indoor units 20*a* and 20*b*. In other words, the identification information and information regarding an operating state of the outdoor unit 10, and the identification information and information regarding an operating state of each indoor unit 20 are stored in, and shared by, each of the storage unit 120 of the outdoor unit 10 and the storage unit 220 of the indoor unit 20.

The indoor unit control unit 230 corresponds to the control unit 230 shown in FIG. 1. The indoor unit control unit 230 controls each unit of the indoor unit 20. For example, the indoor unit control unit 230 is configured to include a CPU, a memory, and the like. The indoor unit control unit 230 includes a communication control unit 231, an operation control unit 232, and a state detection unit 233, as functional configurations realized by executing the control program stored in the storage unit 220.

The communication control unit 231 controls communication with the outdoor unit 10 via the wired communication unit 210 and the communication line 101. For example, the communication control unit 231 of the indoor unit 20*a* associates the identification information ("ID21") and information regarding an operating state of the indoor unit 20*a* with each other, and transmits the associated information to the outdoor unit 10. The communication control unit 231 of the indoor unit 20*b* associates the identification information ("ID22") and information regarding an operating state of the indoor unit 20*b* with each other, and transmits the associated information to the outdoor unit 10. The communication control unit 231 of the indoor unit 20*c* associates the identification information ("ID23") and information regarding an operating state of the indoor unit 20*c* with each other, and transmits the associated information to the outdoor unit 10.

Further, the communication control unit 231 of the indoor unit 20*a* acquires from the outdoor unit 10, the information in which the identification information and information regarding an operating state of each of the other indoor units 20*b* and 20*c* are associated with each other. Further, the communication control unit 231 acquires from the outdoor unit 10, the information in which the identification information and information regarding an operating state of the outdoor unit 10 are associated with each other. The communication control unit 231 causes the storage unit 220 to store each information acquired from the outdoor unit 10.

Further, the communication control unit 231 of the indoor unit 20*a* controls communication with the antenna unit 30 via the wired communication unit 210 and the communication line 102. The communication control unit 231 of the indoor unit 20*a* acquires the identification information ("ID31") of the antenna unit 30 from the antenna unit 30 and causes the storage unit 220 to store the acquired identification information.

Further, the communication control unit 231 of the indoor unit 20*a* associates the information stored by each of the outdoor unit 10 and the indoor units 20*a*, 20*b*, and 20*c* with the identification information of a respective device and the identification information of the antenna unit 30, and transmits the associated information to the external operation terminal 60 via the antenna unit 30.

FIG. 3 is a diagram showing an example of information to be transmitted to the external operation terminal 60 by the indoor unit 20*a* according to the present embodiment. An example of the information to be transmitted to the external operation terminal 60 shown in this figure is information for the external operation terminal 60 to monitor operating states of the outdoor unit 10 and the indoor units 20, in which the identification information and information regarding an operating state of each device are associated with each other. The information in which the identification information and information regarding an operating state of each device are associated with each other is hereinafter referred to as "operating state information."

For example, the communication control unit 231 of the indoor unit 20*a* associates the identification information ("ID31") of the antenna unit 30, the identification information ("ID11") of the outdoor unit 10, and the information regarding an operating state of the outdoor unit 10 (operating, internal temperature, external air temperature, . . . ) with one another, and transmits the associated information as the operating state information of the outdoor unit 10 to the external operation terminal 60 via the antenna unit 30. Further, the communication control unit 231 of the indoor unit 20*a* associates the identification information ("ID31") of the antenna unit 30, the identification information ("ID21") of the indoor unit 20*a*, and the information regarding an operating state of the indoor unit 20*a* (operating, cooling, set temperature, internal temperature, room temperature, . . . ) with one another, and transmits the associated information as the operating state information of the indoor unit 20*a* to the external operation terminal 60 via the antenna unit 30. Further, the communication control unit 231 of the indoor unit 20*a* associates the identification information ("ID31") of the antenna unit 30, the identification information ("ID22") of the indoor unit 20*b*, and the information regarding an operating state of the indoor unit 20*b* (operating, cooling, set temperature, internal temperature, room temperature, . . . ) with one another, and transmits the associated information as the operating state information of the indoor unit 20*b* to the external operation terminal 60 via the antenna unit 30. Further, the communication control unit 231 of the indoor unit 20*a* associates the identification information ("ID31") of the antenna unit 30, the identification information ("ID23") of the indoor unit 20*c*, and the information regarding an operating state of the indoor unit 20*c* (operating, cooling, set temperature, internal temperature, room temperature, . . . ) with one another, and transmits the associated information as the operating state information of the indoor unit 20*c* to the external operation terminal 60 via the antenna unit 30.

Further, the communication control unit 231 acquires operation instruction information indicating operation instructions for each of the indoor units 20*a*, 20*b*, and 20*c* from the external operation terminal 60 via the antenna unit 30. In the operation instruction information, the identification information of the indoor unit 20 to be operated, the identification information of the antenna unit 30, and the information indicating operation details are associated with one another. The operation details refer to the details of operation for the indoor unit 20, such as an operation to start operation, an operation to stop operation, an operation to switch between cooling operation, heating operation, and ventilating operation, an operation to set a set temperature, an operation to set an air volume, and the like.

FIG. 4 is a diagram showing an example of the operation instruction information according to the present embodiment. For example, when an operation instruction is given to the indoor unit 20*a* on the external operation terminal 60, the communication control unit 231 of the indoor unit 20*a* acquires from the external operation terminal 60 via the antenna unit 30, operation instruction information in which the identification information ("ID31") of the antenna unit 30, the identification information ("ID21") of the indoor unit 20*a*, and the operation details for the indoor unit 20*a* are associated with one another. Further, when an operation instruction is given to the indoor unit 20*b* on the external operation terminal 60, the communication control unit 231 of the indoor unit 20*a* acquires from the external operation terminal 60 via the antenna unit 30, operation instruction information in which the identification information ("ID31") of the antenna unit 30, the identification information ("ID22") of the indoor unit 20*b*, and the operation details for the indoor unit 20*b* are associated with one another. Further, when an operation instruction is given to the indoor unit 20*c* on the external operation terminal 60, the communication control unit 231 of the indoor unit 20*a* acquires from the external operation terminal 60 via the antenna unit 30, operation instruction information in which the identification information ("ID31") of the antenna unit 30, the identification information ("ID23") of the indoor unit 20*c*, and the operation details for the indoor unit 20*c* are associated with one another. The communication control unit 231 of the indoor unit 20*a* transmits the acquired operation identification information to each of the indoor units 20*b* and 20*c* via the outdoor unit 10.

Returning to FIG. 2, the operation control unit 232 controls operation of the indoor unit 20. Specifically, the operation control unit 132 of each indoor unit 20 controls the indoor unit fan 241, the flap 243, and the like, which are provided in each indoor unit 20. For example, when receiving an operation instruction signal output from the remote controller 40*a*, the operation control unit 232 of the indoor unit 20*a* controls operation of the indoor unit 20*a* based on the operation details included in the received operation instruction signal. When receiving an operation instruction signal output from the remote controller 40*b*, the operation control unit 232 of the indoor unit 20*b* controls operation of the indoor unit 20*b* based on the operation details included in the received operation instruction signal. When receiving an operation instruction signal output from the remote controller 40*c*, the operation control unit 232 of the indoor unit 20*c* controls operation of the indoor unit 20*c* based on the operation details included in the received operation instruction signal.

Further, when the communication control unit 231 of the indoor unit 20*a* acquires the operation instruction information in which the identification information ("ID31") of the antenna unit 30 and the identification information ("ID21") of the indoor unit 20*a* are associated with each other, the operation control unit 232 of the indoor unit 20*a* controls operation of the indoor unit 20*a* based on the operation details included in the operation instruction information. When the communication control unit 231 of the indoor unit 20*b* acquires the operation instruction information in which the identification information ("ID31") of the antenna unit 30 and the identification information ("ID22") of the indoor unit 20*b* are associated with each other, the operation control unit 232 of the indoor unit 20*b* controls operation of the indoor unit 20*b* based on the operation details included in the operation instruction information. When the communication control unit 231 of the indoor unit 20*c* acquires the operation instruction information in which the identification information ("ID31") of the antenna unit 30 and the identification information ("ID23") of the indoor unit 20*c* are associated with each other, the operation control unit 232 of the indoor unit 20*c* controls operation of the indoor unit 20*c* based on the operation details included in the operation instruction information. In other words, each of the indoor units controls operation thereof based on the operation details included in the operation instruction information when it is identified to be the operation target by the identification information of the indoor unit 20 included in the operation instruction information acquired by the communication control unit 231.

The state detection unit 233 detects a state of each unit of the indoor unit 20. The state detection unit 233 periodically detects an operating state (operating, stopped, set temperature, or the like) of the indoor unit 20 controlled by the operation control unit 232. Further, the state detection unit 233 periodically detects an internal temperature and a room temperature based on sensor outputs of the internal temperature sensor 244 and the room temperature sensor 245. The internal temperature sensor 244 is a temperature sensor provided inside the indoor unit 20 to detect a temperature inside the indoor unit 20. For example, the internal temperature sensor 244 detects a temperature of the heat exchanger 242 or the like. The room temperature sensor 245 is a temperature sensor provided in the indoor unit 20 to detect a room temperature. The state detection unit 233 causes the storage unit 220 to store the detected operating state, internal temperature, room temperature, and the like, as the information regarding the operating state.

(Configuration of Antenna Unit 30)

Next, a configuration of the antenna unit 30 will be explained. The antenna unit shown in FIG. 2 includes a wired communication unit 310, a wireless communication unit 320, a storage unit 330, and a communication control unit 340.

The wired communication unit 310 is configured to include a communication device for communicating with the outdoor unit 10 or any one of the indoor units 20. In the illustrated example, the wired communication unit 310 is connected to the indoor unit 20*a* via the communication line 102, and communicates with the indoor unit 20*a*.

The wireless communication unit 320 is configured to include a communication device for wirelessly communicating with the repeater 50. For example, the repeater 50 is a wireless LAN router. The wireless communication unit 320 is configured to include a communication device such as an antenna for connecting to the repeater 50 via a wireless LAN.

The storage unit 330 stores the identification information ("ID31") of the antenna unit 30, a control program for controlling operation of the antenna unit 30, and the like.

The communication control unit 340 is configured to include a CPU, a memory, and the like. The communication control unit 340 controls each unit of the antenna unit by executing the control program stored in the storage unit 330. Specifically, the communication control unit 340 controls communication with the indoor unit 20*a* via the wired communication unit 310. Further, the communication control unit 340 controls communication with the repeater 50 via the wireless communication unit 320.

When the antenna unit 30 is connected to the indoor unit 20*a*, the communication control unit 340 performs negotiation for a communication speed and a communication method, transmits the information of the antenna unit 30 to the indoor unit 20*a* via the wired communication unit 310, and also receives the information of the indoor unit 20*a* from the indoor unit 20*a* via the wired communication unit 310. For example, the communication control unit 340 transmits the identification information ("ID31") of the antenna unit 30 to the indoor unit 20*a*. Further, the communication control unit 340 receives the identification information ("ID21") of the indoor unit 20*a* from the indoor unit 20*a*.

After communication is established by the negotiation, the communication control unit 340 acquires various information transmitted from the indoor unit 20*a* via the wired communication unit 310, and transmits the acquired various information to the repeater 50 via the wireless communication unit 320. Further, the communication control unit 340 acquires various information transmitted from the repeater 50 via the wireless communication unit 320, and transmits the acquired various information to the indoor unit 20*a* via the wired communication unit 310.

Next, a flow of processing in the air conditioner system 1 will be described.

(Initialization Process)

Figure 5:
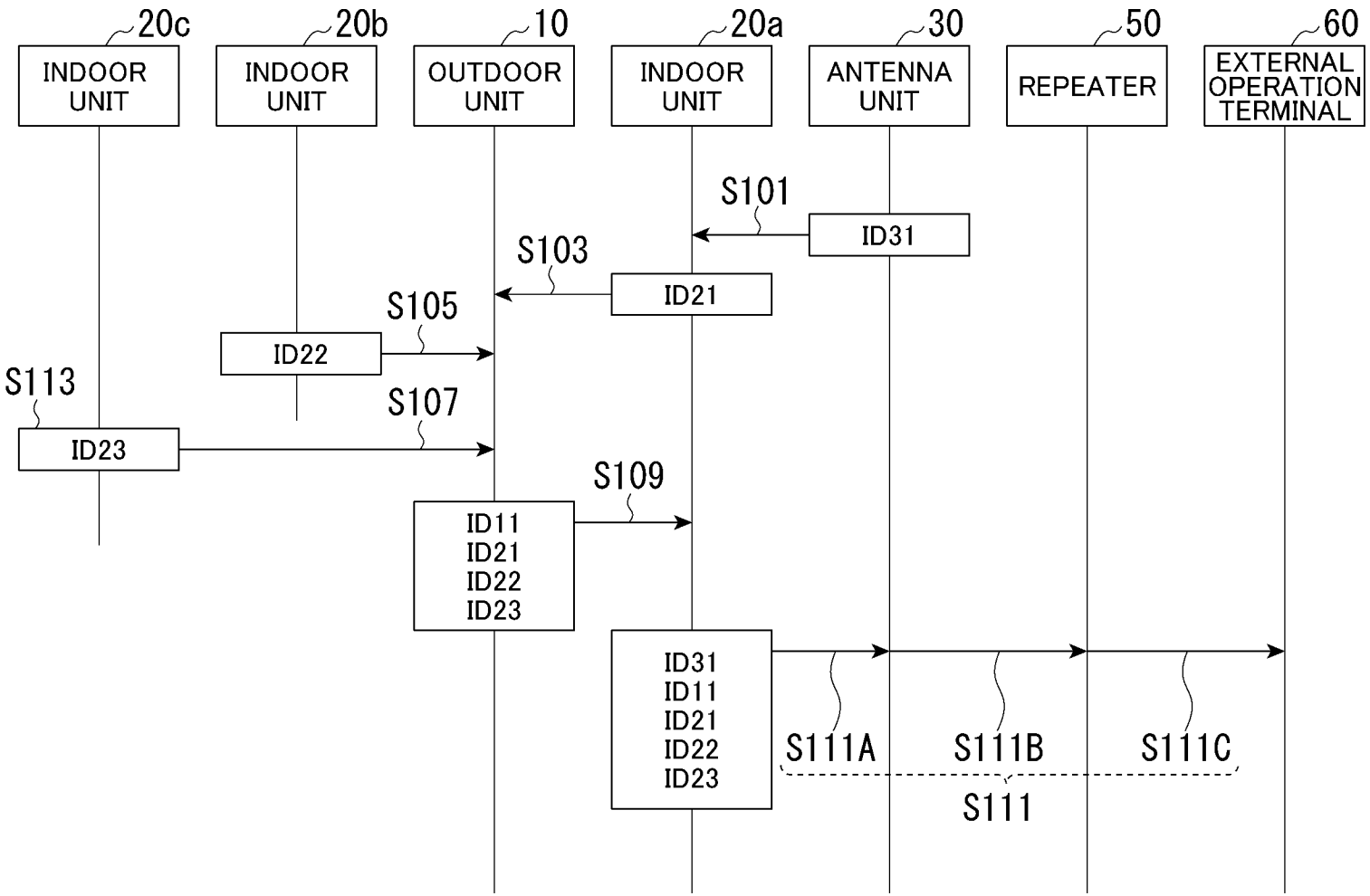
FIG. 5 is a sequence diagram showing an example of initialization processing according to the first embodiment.

First, a flow of initialization processing for grouping the identification information of the devices connected to the air conditioner system 1 to make them recognizable by the external operation terminal 60 will be described. FIG. 5 is a sequence diagram showing an example of the initialization processing according to the present embodiment.

(Step S101) When the antenna unit 30 is connected to the indoor unit 20*a*, the antenna unit 30 and the indoor unit 20*a* perform a negotiation process for communication. In the negotiation process, the antenna unit 30 transmits the identification information ("ID31") of the antenna unit 30 to the indoor unit 20*a*. The indoor unit 20*a* acquires and stores the identification information ("ID31") of the antenna unit 30 transmitted from the antenna unit 30.

(Step S103) The indoor unit 20*a* transmits the identification information ("ID21") of the indoor unit 20*a* to the outdoor unit 10. The outdoor unit 10 acquires the identification information ("ID21") of the indoor unit 20*a* transmitted from the indoor unit 20*a* and stores the acquired identification information in the storage unit 220.

(Step S105) The indoor unit 20*b* transmits the identification information ("ID22") of the indoor unit 20*b* to the outdoor unit 10. The outdoor unit 10 acquires the identification information ("ID22") of the indoor unit 20*b* transmitted from the indoor unit 20*b* and stores the acquired identification information in the storage unit 220.

(Step S107) The indoor unit 20*c* transmits the identification information ("ID23") of the indoor unit 20*c* to the outdoor unit 10. The outdoor unit 10 acquires the identification information ("ID23") of the indoor unit 20*c* transmitted from the indoor unit 20*c* and stores the acquired identification information in the storage unit 220.

(Step S109) The outdoor unit 10 associates the identification information ("ID21") of the indoor unit 20*a*, the identification information ("ID22") of the indoor unit 20*b*, and the identification information ("ID23") of the indoor unit 20*c* with the identification information ("ID11") of the outdoor unit 10 to group them into an identification information group of the devices included in the air conditioner system 1. Then, the outdoor unit 10 transmits the grouped identification information group to the indoor unit 20*a*. The indoor unit 20*a* acquires the identification information group transmitted from the outdoor unit 10 and stores the acquired identification information group in the storage unit 220 of the indoor unit 20*a*.

(Step S111) The indoor unit 20*a* associates the identification information group ("ID11", "ID21", "ID22", "ID23") acquired from the outdoor unit 10 with the identification information ("ID31") of the antenna unit 30, and transmits the associated information to the external operation terminal 60. By associating the identification information ("ID31") of the antenna unit 30, it is possible to distinguish the identification information group of the devices included in this air conditioner system 1 and an identification information group of devices included in another air conditioner system. The identification information group data transmitted from the indoor unit 20*a* to the external operation terminal 60 is first transmitted from the indoor unit 20*a* to the antenna unit 30 (step S111A), then is transmitted from the antenna unit 30 to the repeater 50 (step S111B), and then is transmitted from the repeater 50 to the external operation terminal 60 (step S111C). As a result, the external operation terminal 60 can identify the devices included in the air conditioner system 1 using the identification information of each device.

(Operating State Monitor Processing)

Next, a flow of processing for monitoring an operating state of each device of the air conditioner system 1 using the external operation terminal 60 will be described.

Figure 6:
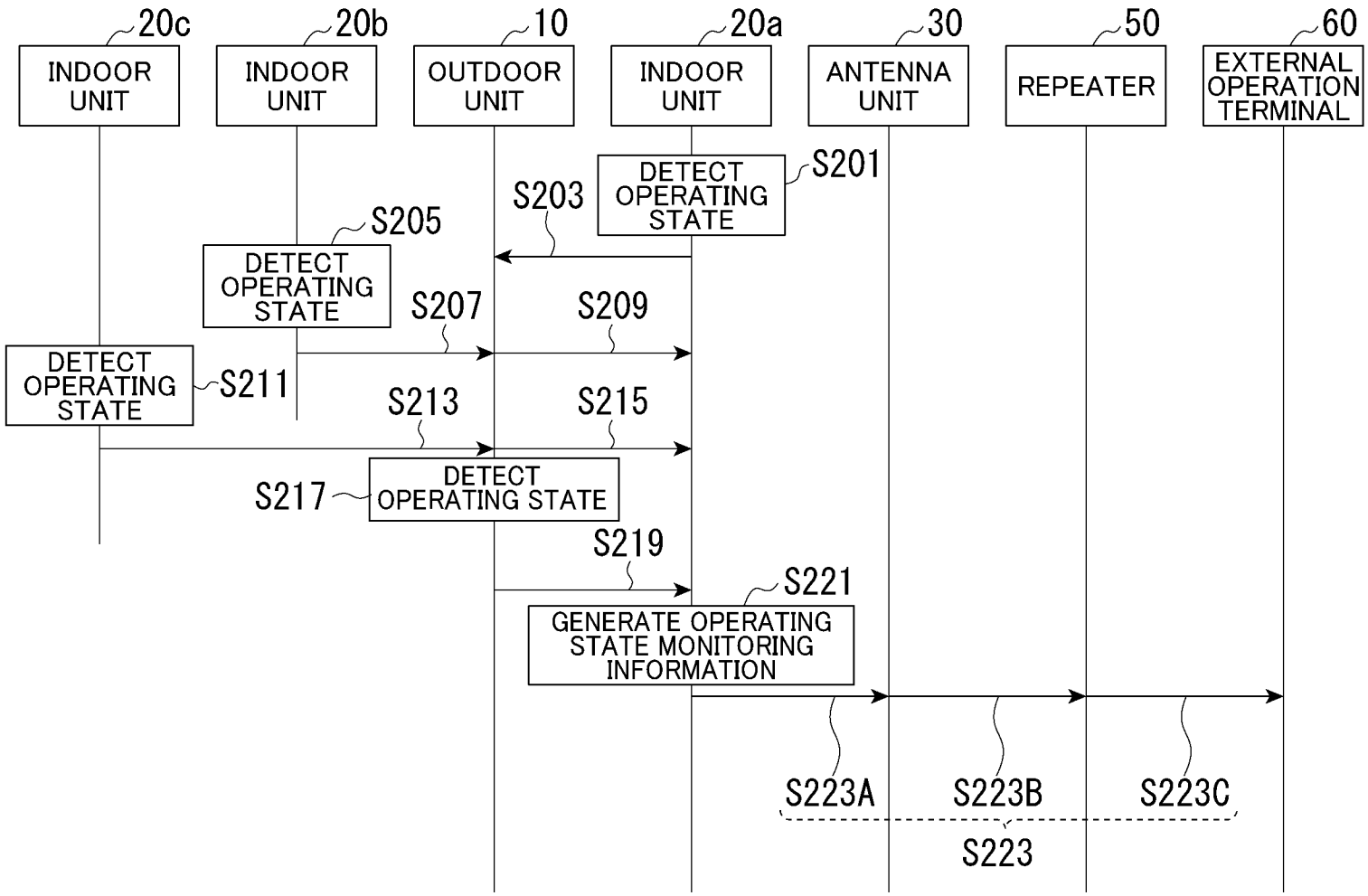
FIG. 6 is a sequence diagram showing a flow of operating state monitoring processing according to the first embodiment.

FIG. 6 is a sequence diagram showing the flow of the operating state monitoring processing according to the present embodiment.

(Step S201) The indoor unit 20*a* detects information regarding an operating state of the indoor unit 20*a*, associates the detected information regarding the operating state with the identification information ("ID21") of the indoor unit 20*a*, and stores the associated information in the storage unit 220 of the indoor unit 20*a*.

(Step S203) The indoor unit 20*a* transmits to the outdoor unit 10, the information in which the information regarding the operating state and the identification information ("ID21") are associated with each other. The outdoor unit 10 acquires the information in which the information regarding the operating state and the identification information ("ID21") are associated with each other, which is transmitted from the indoor unit 20*a*, and stores the acquired information in the storage unit 120.

(Step S205) The indoor unit 20*b* detects information regarding an operating state of the indoor unit 20*b*, associates the detected information regarding the operating state with the identification information ("ID22") of the indoor unit 20*b*, and stores the associated information in the storage unit 220 of the indoor unit 20*b*.

(Step S207) The indoor unit 20*b* transmits to the outdoor unit 10, the information in which the information regarding the operating state and the identification information ("ID22") are associated with each other. The outdoor unit 10 acquires the information transmitted from the indoor unit 20*b* in which the identification information ("ID22") and information regarding the operating state are associated with each other, and stores the acquired information in the storage unit 120.

(Step S209) The outdoor unit 10 transmits to the indoor unit 20*a*, the information acquired from the indoor unit 20*b* in which the information regarding the operating state and the identification information ("ID22") are associated with each other. The indoor unit 20*a* stores in the storage unit 220 of the indoor unit 20*a*, the information transmitted from the outdoor unit 10 in which the identification information ("ID22") and information regarding the operating state of the indoor unit 20*b* are associated with each other.

(Step S211) The indoor unit 20*c* detects information regarding an operating state of the indoor unit 20*c*, associates the detected information regarding the operating state with the identification information ("ID23") of the indoor unit 20*c*, and stores the associated information in the storage unit 220 of the indoor unit 20*c*.

(Step S213) The indoor unit 20*c* transmits to the outdoor unit 10, the information in which the information regarding the operating state the identification information ("ID23") are associated with each other. The outdoor unit 10 acquires the information transmitted from the indoor unit 20*c* in which the identification information ("ID23") and information regarding the operating state are associated with each other, and stores the acquired information in the storage unit 120.

(Step S215) The outdoor unit 10 transmits to the indoor unit 20*a*, the information acquired from the indoor unit 20*c* in which the information regarding the operating state and identification information ("ID23") are associated with each other. The indoor unit 20*a* stores in the storage unit 220 of the indoor unit 20*a*, the information transmitted from the outdoor unit 10 in which the identification information ("ID23") and information regarding the operating state of the indoor unit 20*c* are associated with each other.

(Step S217) The outdoor unit 10 detects information regarding an operating state of the outdoor unit 10, associates the detected information regarding the operating state with the identification information ("ID11") of the outdoor unit 10, and stores the associated information in the storage unit 120.

(Step S219) The outdoor unit 10 transmits to the indoor unit 20*a*, the information in which the information regarding the operating state and the identification information ("ID11") are associated with each other. The indoor unit 20*a* stores in the storage unit 220 of the indoor unit 20*a*, the information transmitted from the outdoor unit 10 in which the identification information ("ID11") and information regarding the operating state of the outdoor unit 10 are associated with each other.

(Step S221) The indoor unit 20*a* generates operating state information of the outdoor unit 10 (see FIG. 3) in which the identification information ("ID11") and information regarding the operating state of the outdoor unit 10 are associated with the identification information ("ID31") of the antenna unit 30. The indoor unit 20*a* generates operating state information of the indoor unit 20*a* (see FIG. 3) in which the identification information ("ID21") and information regarding the operating state of the indoor unit 20*a* are associated with the identification information ("ID31") of the antenna unit 30. The indoor unit 20*b* generates operating state information of the indoor unit 20*b* (see FIG. 3) in which the identification information ("ID22") and information regarding the operating state of the indoor unit 20*b* are associated with the identification information ("ID31") of the antenna unit 30. The indoor unit 20*a* generates operating state information of the indoor unit 20*c* (see FIG. 3) in which the identification information ("ID23") and information regarding the operating state of the indoor unit 20*c* are associated with the identification information ("ID31") of the antenna unit 30.

(Step S223) The indoor unit 20*a* transmits to the external operation terminal 60, the operating state information of the outdoor unit 10, the operating state information of the indoor unit 20*a*, the operating state information of the indoor unit 20*b*, and the operating state information of the indoor unit 20*c*. Each operating state information transmitted from the indoor unit 20*a* to the external operation terminal 60 is first transmitted from the indoor unit 20*a* to the antenna unit 30 (step S223A), then is transmitted from the antenna unit 30 to the repeater 50 (step S223B), and then is transmitted from the repeater 50 to the external operation terminal 60 (step S223C). As a result, the external operation terminal 60 can monitor an operating state of each device included in the air conditioner system 1.

Here, the processing from step S201 to step S223 is repeatedly performed at a predetermined interval. Further, the order of processes in which the outdoor unit 10 and each indoor unit 20 detect and transmit an operating state may be changed. Further, the processes in which the outdoor unit 10 and each indoor unit 20 detect and transmit an operating state may be performed synchronously with a specific period.

(Operation Instruction Processing)

Next, a flow of operation instruction processing when an operation instruction for the air conditioner system 1 is given from the external operation terminal 60 will be described. Using the external operation terminal 60, the user can collectively give operation instructions to the respective devices of the air conditioner system 1.

Figure 7:
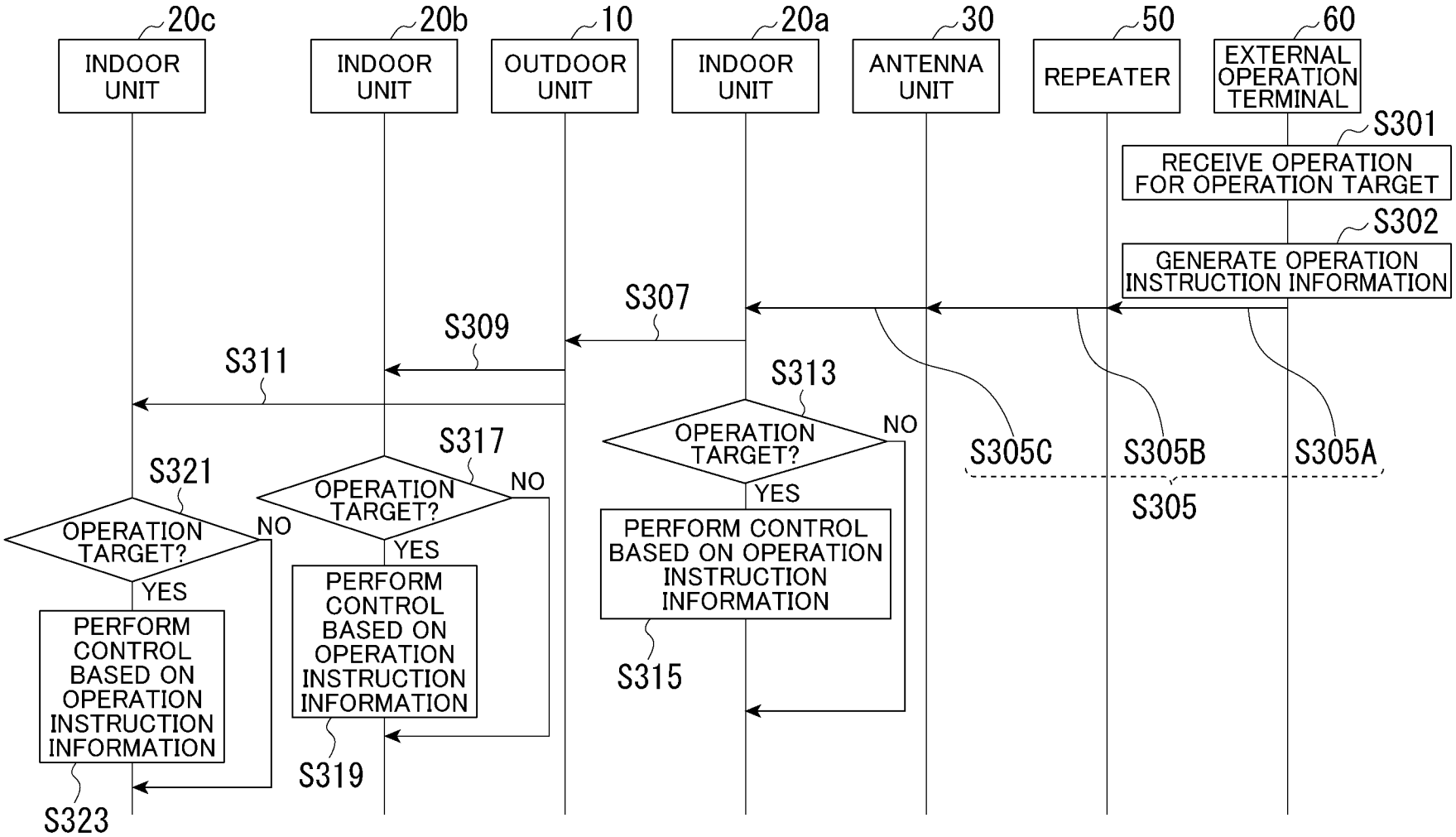
FIG. 7 is a sequence diagram showing a flow of operation instruction processing according to the first embodiment.

FIG. 7 is a sequence diagram showing a flow of the operation instruction processing according to the present embodiment.

(Step S301) The external operation terminal 60 receives a user operation for the indoor unit 20 to be operated by the air conditioner system 1. For example, the external operation terminal 60 displays an operation screen for receiving respective operations for the indoor units 20*a*, 20*b*, and 20*c*, and receives user operations on the operation screen.

Operation details for each of the indoor unit 20*a*, the indoor unit 20*b*, and the indoor unit 20*c* are received on this operation screen, where the operation details include operations to start and stop operation, an operation to switch among cooling operation, heating operation, and ventilating operation, an operation to set a set temperature, an operation to set an air volume, and the like.

(Step S303) The external operation terminal 60 generates operation instruction information based on the user operation received in step S301. The operation instruction information includes the identification information of the antenna unit 30 for specifying the air conditioner system 1 to be operated, the identification information of the indoor unit to be operated, and the operation details, which are associated with one another (see FIG. 4). Here, the external operation terminal 60 may generate operation instruction information according to an operation plan in which an operation target, operation details, and time are preset.

(Step S305) The external operation terminal 60 transmits the operation instruction information to the air conditioner system 1. A timing of transmission is a timing according to the user operation in step S301 or a timing according to a preset operation plan. The operation instruction information transmitted from the external operation terminal 60 to the air conditioner system 1 is first transmitted from the external operation terminal 60 to the repeater 50 (step S305A), then is transmitted from the repeater 50 to the antenna unit 30 (step S305B), and then is transmitted from the antenna unit 30 to the indoor unit 20*a* (step S305C).

(Step S307) When the indoor unit 20*a* receives the operation instruction information transmitted from the external operation terminal 60, if the operation instruction information includes the identification information ("ID31") of the antenna unit 30, the indoor unit 20*a* transmits the operation instruction information to the outdoor unit 10. Further, in this case, the indoor unit 20*a* proceeds to the process of step S313.

(Steps S309, S311) When receiving the operation instruction information transmitted from the indoor unit 20*a*, the outdoor unit 10 transmits the operation instruction information to the indoor unit 20*b* and the indoor unit 20*c*. The order of transmission to the indoor unit 20*b* and the indoor unit 20*c* may be either first or at the same time.

(Step S313) Based on the identification information of the indoor unit 20 included in the operation instruction information transmitted from the external operation terminal 60, the indoor unit 20*a* determines whether or not the indoor unit 20*a* is an operation target.

When the identification information of the indoor unit 20 included in the operation instruction information is the identification information ("ID21") of the indoor unit 20*a*, the indoor unit 20*a* determines that the indoor unit 20*a* is the operation target, and proceeds to the process of step S315. On the other hand, when the identification information of the indoor unit 20 included in the operation instruction information is not the identification information ("ID21") of the indoor unit 20*a*, the indoor unit 20*a* determines that the indoor unit 20*a* is not the operation target, and does not perform the process of step S315.

(Step S315) When the indoor unit 20*a* is the operation target of the operation instruction information transmitted from the external operation terminal 60, the indoor unit 20*a* controls operation based on the operation instruction information. Specifically, the indoor unit 20*a* performs control according to the operation details included in the operation instruction information.

(Step S317) Based on the identification information of the indoor unit 20 included in the operation instruction information transmitted from the external operation terminal 60, the indoor unit 20*b* determines whether or not the indoor unit 20*b* is an operation target. When the identification information of the indoor unit 20 included in the operation instruction information is the identification information ("ID22") of the indoor unit 20*b*, the indoor unit 20*b* determines that the indoor unit 20*b* is the operation target, and proceeds to the process of step S319. On the other hand, when the identification information of the indoor unit 20 included in the operation instruction information is not the identification information ("ID22") of the indoor unit 20*b*, the indoor unit 20*b* determines that the indoor unit 20*b* is not the operation target, and does not perform the process of step S319.

(Step S319) When the indoor unit 20*b* is the operation target of the operation instruction information transmitted from the external operation terminal 60, the indoor unit 20*b* controls operation based on the operation instruction information. Specifically, the indoor unit 20*b* performs control according to the operation details included in the operation instruction information.

(Step S321) Based on the identification information of the indoor unit 20 included in the operation instruction information transmitted from the external operation terminal 60, the indoor unit 20*c* determines whether or not the indoor unit 20*c* is an operation target. When the identification information of the indoor unit 20 included in the operation instruction information is the identification information ("ID23") of the indoor unit 20*c*, the indoor unit 20*c* determines that the indoor unit 20*c* is the operation target, and proceeds to the process of step S323. On the other hand, when the identification information of the indoor unit 20 included in the operation instruction information is not the identification information ("ID23") of the indoor unit 20*c*, the indoor unit 20*c* determines that the indoor unit 20*c* is not the operation target, and does not perform the process of step S323.

(Step S323) When the indoor unit 20*c* is the operation target of the operation instruction information transmitted from the external operation terminal 60, the indoor unit 20*c* controls operation based on the operation instruction information. Specifically, the indoor unit 20*c* performs control according to the operation details included in the operation instruction information.

As described above, in the air conditioner system 1 according to the present embodiment, one outdoor unit 10 and the plurality of indoor units 20 are connected via the communication line 101. The air conditioner system 1 is configured to include the antenna unit 30 (an example of a communication unit) and the communication control unit 231. The antenna unit 30 communicates with the external operation terminal 60 (an example of an external device) and one of the outdoor unit 10 and the plurality of indoor units 20. The communication control unit 231 associates the identification information (first identification information) uniquely set to each of the outdoor unit 10 and the plurality of indoor units 20 with the identification information uniquely set to the antenna unit 30 (second identification information), and transmits the associated information to the external operation terminal 60 (the example of the external device) via the antenna unit 30.

As a result, the air conditioner system 1 can identify the air conditioner system 1 and each device using the identification information of the antenna unit 30 and the identification information of each device of the outdoor unit 10 and the plurality of indoor units 20. Therefore, it is possible to collectively manage each device from an external device (for example, the external operation terminal 60) easily with a simple configuration.

For example, the communication control unit 231 associates the information stored by each of the outdoor unit 10 and the plurality of indoor units 20 with the identification information (first identification information) of a respective one of the outdoor unit 10 and the plurality of indoor units 20 and the identification information (second identification information) of the antenna unit 30, and transmits the associated information to the external operation terminal 60 via the antenna unit 30.

As a result, the air conditioner system 1 can identify the information of the air conditioner system 1 and each device using the identification information of the antenna unit 30 and the identification information of each device of the outdoor unit 10 and the plurality of indoor units 20. Therefore, it is possible to collectively manage the information of each device from an external device (for example, the external operation terminal 60) easily with a simple configuration.

Here, the information stored by each of the outdoor unit 10 and the plurality of indoor units 20 includes information regarding a state of a respective one of the outdoor unit 10 and the plurality of indoor units 20.

As a result, the air conditioner system 1 can easily monitor a state of each device from an external device with a simple configuration. Here, the state of each device is, for example, information regarding an operating state of a respective one of the outdoor unit and the plurality of indoor units 20. As described above, the information regarding an operating state includes information indicating an operating state such as operating or stopped, information indicating an operating mode such as cooling, heating, or ventilating, set information such as a set temperature and an air volume, detection information such as a room temperature, an external air temperature, or an internal temperature, and the like. As a result, the air conditioner system 1 can easily monitor an operating state of each device from an external device (for example, the external operation terminal 60) with a simple configuration.

Among the outdoor unit 10 and the plurality of indoor units 20, a device (for example, the indoor unit 20*a*) configured to communicate with the external operation terminal 60 via the antenna unit 30 includes the communication control unit 231. The device (for example, the indoor unit 20*a*) configured to communicate with the external operation terminal 60 acquires from each of the other devices among the outdoor unit 10 and the plurality of indoor units 20, information stored by a respective one of the other devices. Then, the device (for example, the indoor unit 20*a*) configured to communicate with the external operation terminal 60 associates the information acquired from each of the other devices with the identification information (first identification information) of a respective one of the other devices, and stores the associated information.

As a result, in the air conditioner system 1, only one device (for example, the indoor unit 20*a*) among the outdoor unit 10 and the plurality of indoor units 20 communicates with the external operation terminal 60 via the antenna unit 30, so that an operating state of each of the outdoor unit 10 and the plurality of indoor units 20 can be monitored from an external device (for example, the external operation terminal 60).

The communication control unit 231 acquires from the external operation terminal 60 via the antenna unit 30, operation instruction information in which operation details and the identification information (first identification information) of an indoor unit 20 to be an operation target among the plurality of indoor units 20 are associated with the identification information (second identification information) of the antenna unit 30. Each of the plurality of indoor units 20 includes the operation control unit 232 configured to control operation based on the operation details included in the operation instruction information, when a respective one of the plurality of indoor units 20 is identified to be the operation target by the identification information (first identification information) included in the operation instruction information acquired by the communication control unit 231.

As a result, in the air conditioner system 1, it is possible to give an operation instruction from an external device (for example, the external operation terminal 60) individually to each of the indoor units 20 included in the air conditioner system 1. Here, the air conditioner system 1 may be configured to simultaneously give operation instructions each including the same operation details to the respective indoor units 20 included in the air conditioner system 1.

Further, the antenna unit 30 is configured to communicate with the external operation terminal 60 via the repeater 50 (an example of a communication relay device). As a result, the air conditioner system 1 can transmit and receive information to and from an external device (for example, the external operation terminal 60) communicatively connected via the repeater 50.

For example, when the repeater 50 is a wireless LAN router and the antenna unit is connected to the wireless LAN, in the air conditioner system 1, one device (for example, the indoor unit 20*a*) communicates with an external device (for example, the external operation terminal 60) via the wireless LAN. Therefore, it is not necessary to connect the plurality of indoor units 20 to an external device (for example, the external operation terminal 60) via communication lines, thereby achieving a simple configuration. Further, it is not necessary to connect the plurality of indoor units 20 to an external device (for example, the external operation terminal 60) via communication lines, thereby decreasing a risk of communication failure due to disconnection or the like.

In the above case, the air conditioner system 1 can communicate with an external device (for example, the external operation terminal 60) within a communication range of the wireless LAN. On the other hand, in lieu of, or in addition to, the wireless LAN router, a base station for public lines, such as mobile phone communication networks, may be included in the repeater 50. In this case, the air conditioner system 1 can also communicate with an external device (for example, the external operation terminal 60) outside the communication range of the wireless LAN (outdoors, or the like).

Here, the communication method described above is an example, and any communication method can be applied. For example, when the air conditioner system 1 communicates with an external device (for example, the external operation terminal 60) indoors, the communication may be performed using Bluetooth (registered trademark) or the like without using the repeater 50. Further, the communication unit, for which the antenna unit 30 has been described as an example, may be a LAN adapter connected to a wired LAN. In other words, one device (for example, the indoor unit 20*a*) in the air conditioner system 1 and an external device (for example, the external operation terminal 60) may be connected via a communication line (wired).

Further, in the air conditioner system 1, the quantity of antenna units 30 is less than the total quantity of the outdoor unit 10 and the plurality of indoor units 20. As a result, the air conditioner system 1 can communicate with an external device (for example, the external operation terminal 60) with a simple configuration.

Here, in the air conditioner system 1, an indoor unit 20 to be connected to the outdoor unit 10 can be added or deleted later. When an indoor unit 20 is added or deleted, the air conditioner system 1 can update the information of the indoor unit(s) 20 connected to the outdoor unit 10 by performing the initialization process shown in FIG. 5.

Further, the configuration may be not only that each indoor unit 20 is connected to the outdoor unit 10 by a communication line, but also that each indoor unit 20 may be connected to each other by a communication line. As a result, each indoor unit 20 may directly acquire the information of the other indoor units 20 without using the outdoor unit 10.

Further, in the example of the present embodiment, the example in which the antenna unit 30 is externally connected to the indoor unit 20*a* has been illustrated, but the antenna unit 30 may be built in the indoor unit 20*a*. Further, in the example of the present embodiment, the example in which the antenna unit 30 is connected to the indoor unit 20*a* has been illustrated, but the device to be connected with the antenna unit 30 may be any of the indoor units 20, or may be the outdoor unit 10. In lieu of the indoor unit 20*a* described above, a device to be connected with the antenna unit 30 may perform the above-described communication with the external operation terminal 60 or the external management server 70. Further, the outdoor unit 10 and the plurality of indoor units 20 may include a device to be connected with a spare antenna unit 30, in addition to the device to be connected with the antenna unit 30. For example, when the antenna unit 30 is connected to the indoor unit 20*a* and a spare antenna unit 30 is connected to the indoor unit 20*b*, if a failure occurs in communication via the antenna unit 30 by the indoor unit 20*a*, the indoor device 20*b* may perform communication using the spare antenna unit 30. Alternatively, the configuration may be such that antenna units 30 are connected respectively to the outdoor unit 10 and the indoor units 20, and only one of the antenna units 30 functions.

Here, the description has been made in the present embodiment with respect to the example in which the identification information and operating state information of the outdoor unit 10 and the identification information and operating state information of each indoor unit 20 are stored in, and shared by, the storage unit 120 of the outdoor unit 10 and the storage unit 220 of the indoor unit 20, but the example is not limited thereto. The identification information and operating state information of the outdoor unit 10 and the identification information and operating state information of each indoor unit 20 may be stored only in the device (for example, the indoor unit 20*a*) connected with the antenna unit 30.

Second Embodiment

Next, a second embodiment of the present disclosure will be described. In the first embodiment, the example in which the external operation terminal 60 collectively manages one air conditioner system 1 has been described, while in the present embodiment, an example in which a plurality of air conditioner systems are collectively managed will be described.

Figure 8:
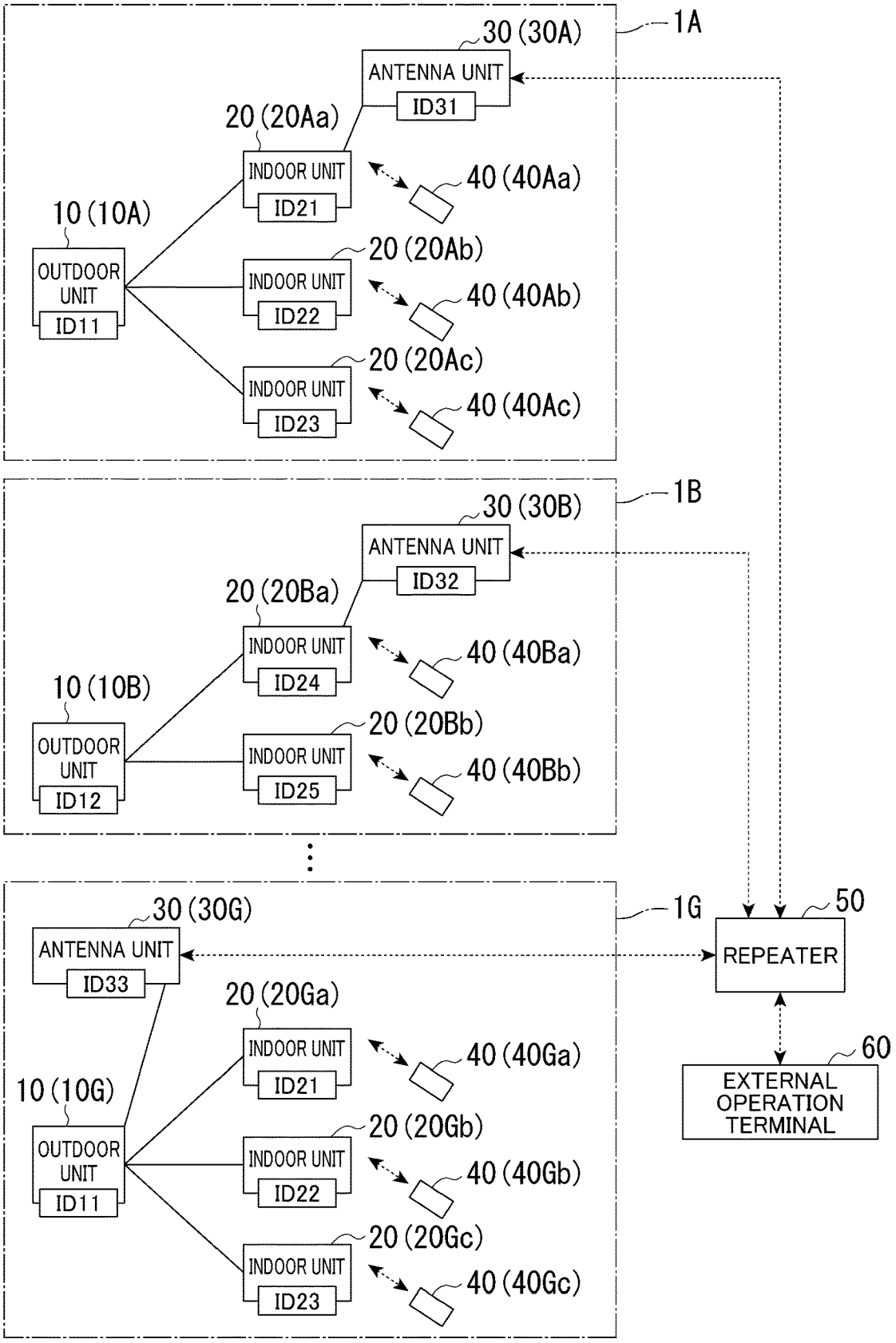
FIG. 8 is a system diagram showing an example of an air conditioner system according to a second embodiment.

FIG. 8 is a system diagram showing an example of an air conditioner system according to the present embodiment. In the example shown in FIG. 8, seven air conditioner systems 1A, 1B, . . . , and 1G are communicatively connected to the external operation terminal 60 via the repeater device 50. Three of the seven air conditioner systems are shown, and the other four are omitted. Here, in FIG. 8, the same reference numerals are given to the configurations corresponding to the respective configurations shown in FIG. 1. Although not shown in FIG. 8, as in the first embodiment, in lieu of, or in addition to, the external operation terminal 60, the external management server 70 may be communicatively connected to the seven air conditioner systems via the repeater 50.

The air conditioner system 1A includes one outdoor unit 10 (10A), three indoor units 20 (20Aa, 20Ab, 20Ac), an antenna unit 30 (30A), and remote controllers 40 (40Aa, 40Ab, 40Ac) corresponding respectively to the three indoor units 20. A basic configuration of the air conditioner system 1A is the same as the configuration of the air conditioner system 1 shown in FIG. 1. The indoor unit 20Aa is connected to the antenna unit 30A in the same manner as the indoor unit 20*a* shown in FIG. 1.

The air conditioner system 1B includes one outdoor unit 10 (10B), two indoor units 20 (20Ba, 20Bb), an antenna unit 30 (30B), and remote controllers 40 (40Ba, 40Bb) corresponding respectively to the two indoor units 20. A basic configuration of the air conditioner system 1B is the same as the configuration of the air conditioner system 1 shown in FIG. 1, except for the difference in the quantity of indoor units. The indoor unit 20Ba is connected to the antenna unit 30B in the same manner as the indoor unit 20*a* shown in FIG. 1.

The air conditioner system 1G includes one outdoor unit 10 (10G), three indoor units 20 (20Ga, 20Gb, 20Gc), an antenna unit 30 (30G), and remote controllers 40 (40Ga, 40Gb, 40Gc) corresponding respectively to the three indoor units 20. A basic configuration of the air conditioner system 1G is the same as the configuration of the air conditioner system 1 shown in FIG. 1, except that the antenna unit 30G is connected to the outdoor unit, instead of the indoor unit. In lieu of the indoor unit 20*a* shown in FIG. 1, the outdoor unit 10G is communicatively connected to the external operation terminal 60 via the repeater 50. As described above, information regarding an operating state of each of the outdoor unit 10 and the indoor units 20 is shared by all of the outdoor unit 10 and the indoor units 20. Therefore, the antenna unit 30 may be connected to any of the outdoor unit 10 and the indoor units 20.

Further, in the air conditioner system 1A, identification information of the outdoor unit 10A is set to "ID11," identification information of the indoor units 20Aa, 20Ab, and 20Ac are set respectively to "ID21," "ID22," and "ID23," and identification information of the antenna unit 30A is set to "ID31." In the air conditioner system 1B, identification information of the outdoor unit 10B is set to "ID12," identification information of the indoor units 20Ba and 20Bb are set respectively to "ID24" and "ID25," and identification information of the antenna unit 30B is set to "ID32." In the air conditioner system 1G, identification information of the outdoor unit 10G is set to "ID11," identification information of the indoor units 20Ga, 20Gb, and 20Gc are set respectively to "ID21," "ID22," and "ID23," and identification information of the antenna unit 30G is set to "ID33."

Since the identification information of the antenna unit 30 of each of the air conditioner systems 1A, 1B, . . . , and 1G differs from one another, the external operation terminal 60 can distinguish each of the air conditioner systems 1A, 1B, . . . , and 1G. On the other hand, the identification information of the outdoor unit 10 and the indoor units differ between the air conditioner system 1A and the air conditioner system 1B, and are the same between the air conditioner system 1A and the air conditioner system 1G. Since the identification information of the antenna unit 30 for each air conditioner system differs from one another, the external operation terminal 60 can distinguish the outdoor unit 10 and the plurality of indoor units 20 of the air conditioning system 1A from the outdoor unit and the plurality of indoor units 20 of the air conditioning system 1G, even when the identification information of the outdoor unit 10 and the indoor units 20 are the same between the air conditioner system 1A and the air conditioner system 1G.

Therefore, in the present embodiment, the external operation terminal 60 can distinguish, monitor an operating state of, and give operation instructions to, each of the outdoor unit 10 and the plurality of indoor units 20 of each of the plurality of air conditioning systems 1A, 1B, . . . , and 1G.

Here, the quantity of indoor units 20 included in each of the air conditioner system 1A, the air conditioner system 1B, and the air conditioner system 1G shown in FIG. 8 is an example, and may be arbitrary. Further, an indoor unit 20 can be added or deleted later.

Figure 9:
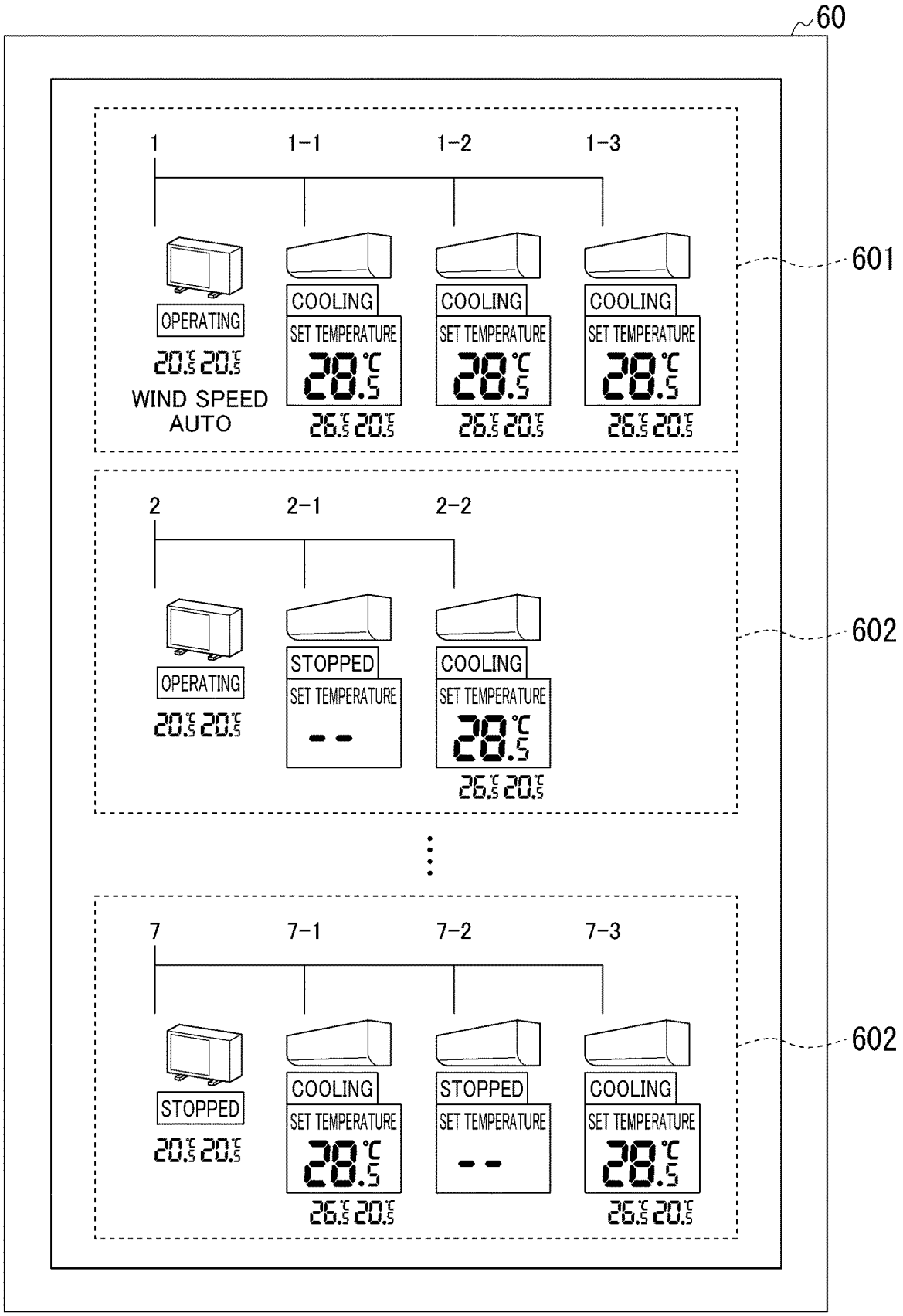
FIG. 9 is a diagram showing an example of an operating state monitoring screen according to the second embodiment.

FIG. 9 is a diagram showing an example of an operating state monitoring screen according to the present embodiment. The operating state monitoring screen shown in FIG. 9 is an example in which the external operation terminal 60 acquires and displays information regarding an operating state of each of the outdoor unit 10 and the plurality of indoor units 20 of each of the air conditioning systems 1A, 1B, . . . , and 1G shown in FIG. 8. The information regarding the operating state of each of the outdoor unit 10 and the plurality of indoor units 20 of each of the air conditioning systems 1A, 1B, . . . , and 1G is displayed so that the information for each air conditioning system is distinguishable from one another. In a display area indicated by reference numeral 601, information regarding operating states of the outdoor unit 10 and the three indoor units 20 of the air conditioning system 1A are displayed. In a display area indicated by reference numeral 602, information regarding operating states of the outdoor unit 10 and the two indoor units 20 of the air conditioning system 1B are displayed. In a display area indicated by reference numeral 603, information regarding operating states of the outdoor unit 10 and the three indoor units 20 of the air conditioning system 1G are displayed. The information regarding the operating state includes, for example, any one of operating, stopped, set temperature, set air volume, internal temperature, external air temperature, room temperature, and the like.

Here, in the example of the monitoring screen shown in FIG. 8, the information regarding the operating states of the three air conditioner systems 1A, 1B, and 1G are shown as a representative example, but in reality, information regarding operating states of the seven air conditioner systems are displayed when monitoring information regarding operating states of the seven air conditioner systems. If the information of all the air conditioner systems cannot be displayed on one screen, the external operation terminal 60 may scroll the display. Alternatively, the external operation terminal 60 may display on the screen, options of the air conditioner systems to be displayed, and thereafter switch to a screen that displays only the information regarding the operating state of the selected air conditioner system.

As described above, an operating state of each device of the outdoor unit 10 and the indoor units 20 included in each of the plurality of air conditioning systems 1A, 1B, . . . , and 1G can be monitored from an external device (for example, the external operation terminal 60). Further, an external device (for example, the external operation terminal 60) can give an operation instruction to each device of the indoor units 20 included in each of the plurality of air conditioner systems 1A, 1B, . . . , and 1G. Therefore, each device of the outdoor unit 10 and the indoor units 20 of each of the plurality of air conditioning systems 1A, 1B, . . . , and 1G can be collectively managed from an external device (for example, the external operation terminal 60) easily with a simple configuration.

Here, a program for realizing the functions of the outdoor unit control unit 130, the indoor unit control unit 230, and the communication control unit 340 may be recorded in a computer-readable recording medium, so that a computer system can read and execute the program recorded in the recording medium to perform the processing of each control unit. Here, the "computer system" referred to here includes an OS and hardware such as peripheral devices.

Further, the "computer-readable recording medium" refers to portable media such as flexible disks, magneto-optical disks, ROMs and CD-ROMs, and storage devices such as hard disks built into computer systems. Further, the "computer-readable recording medium" includes: a medium that dynamically retains a program for a short period of time, like a communication line in a case where the program is transmitted via a network such as the Internet or a communication line such as a telephone line; and a medium that retains a program for a certain period of time, such as a volatile memory inside a computer system that serves as a server or a client in the above case. Further, the program may be one for realizing part of the functions described above, or may be one capable of realizing the functions described above in combination with a program already recorded in the computer system. Further, the above program may be stored in a predetermined server, so that it will be distributed (downloaded, or the like) via a communication line in response to a request from another device.

Further, part or all of the functions of the outdoor unit control unit 130, the indoor unit control unit 230, and the communication control unit 340 may be realized as an integrated circuit such as an LSI (Large Scale Integration). Each function may be individually processorized, and part or all of the functions may be integrated and processorized. Further, the integrated circuit is not limited to LSI, and may be realized as a dedicated circuit or a general-purpose processor. Further, when an integrated circuit technology that replaces LSI appears due to advances in semiconductor technology, an integrated circuit based on that technology may be used.

Although the embodiments of the present disclosure have been described in detail with reference to the drawings, the specific configurations are not limited to these embodiments, and includes designs and the like, which do not deviate from the gist of the present disclosure.

The invention claimed is:

1. An air conditioner system having a plurality of air conditioners in each of which an outdoor unit and a plurality of indoor units are connected via a communication line, the air conditioner system comprising:

a first air conditioner configured to include a plurality of first indoor units; and a second air conditioner configured to include a plurality of second indoor units, the first air conditioner having:

a first communication unit configured to communicate with an external device, a first outdoor unit, and one first indoor unit of the plurality of first indoor units; and a first communication control unit configured to, as information for identifying each of the first outdoor unit and the plurality of first indoor units, associate first identification information uniquely set to each of the first outdoor unit and the plurality of first indoor units with second identification information uniquely set to the first communication unit as associated information, and transmit the associated information from the first outdoor unit or the one first indoor unit that communicates with the first communication unit, to the external device via the first communication unit, the second air conditioner having:

a second communication unit configured to communicate with the external device, a second outdoor unit, and one second indoor unit of the plurality of second indoor units; and a second communication control unit configured to, as information for identifying each of the second outdoor unit and the plurality of second indoor units, associate first identification information uniquely set to each of the second outdoor unit and the plurality of second indoor units with second identification information uniquely set to the second communication unit as associated information, and transmit the associated information from the second outdoor unit or the one second indoor unit that communicates with the second communication unit, to the external device via the second communication unit, wherein the first identification information in the first air conditioner and the first identification information in the second air conditioner are allowed to include same first identification information, and the second identification information in the first air conditioner and the second identification information in the second air conditioner are different.

2. The air conditioner system of claim 1, wherein the first communication control unit is configured to associate information stored by each of the first outdoor unit and the plurality of first indoor units with first identification information of a respective one of the first outdoor unit and the plurality of first indoor units and second identification information as the associated information, and transmit the associated information from the first outdoor unit and the one first indoor unit that communicates with the first communication unit, to the external device via the first communication unit, and the second communication control unit is configured to associate information stored by each of the second outdoor unit and the plurality of second indoor units with the first identification information of a respective one of the second outdoor unit and the plurality of second indoor units and second identification information as the associated information, and transmit the associated information from the first outdoor unit and the one first indoor unit that communicates with the second communication unit, to the external device via the second communication unit.

3. The air conditioner system of claim 2, wherein the information stored by each of the outdoor unit and the plurality of indoor units includes information regarding a state of a respective one of the outdoor unit and the plurality of indoor units.

4. The air conditioner system of claim 1, wherein in the first air conditioner, the first communication control unit is provided in a first device among the first outdoor unit and the plurality of first indoor units that communicates with the external device via the first communication unit, and the first device that communicates with the external device is configured to acquire from each of other first devices among the first outdoor unit and the plurality of first indoor units other than the first device, information stored by a respective one of the other first devices, as acquired information, associate the acquired information with first identification information of the respective one of the other first devices as the associated information, and store the associated information, and in the second air conditioner, the second communication control unit is provided in a second device that among the second outdoor unit and the plurality of second indoor units that communicates with the external device via the second communication unit, and the second device that communicates with the external device is configured to acquire from each of other second devices among the second outdoor unit and the plurality of second indoor units other than the second device, information stored by a respective one of the other second devices as acquired information, associate the acquired information with first identification information of the respective one of the other second devices as associated information, and store the associated information.

5. The air conditioner system of claim 1, wherein the first communication control unit is configured to acquire from the external device via the first communication unit, operation instruction information in which operation details and first identification information of an indoor unit to be an operation target among the plurality of first indoor units are associated with second identification information, and each of the plurality of first indoor units comprises an operation control unit configured to control operation based on the operation details included in the operation instruction information, when a respective one of the plurality of first indoor units is identified to be the operation target by first identification information included in the operation instruction information acquired by the first communication control unit, and the second communication control unit is configured to acquire from the external device via the second communication unit, operation instruction information in which operation details and first identification information of an indoor unit to be an operation target among the plurality of second indoor units are associated with second identification information, and each of the plurality of first indoor units comprises an operation control unit configured to control operation based on the operation details included in the operation instruction information, when a respective one of the plurality of second indoor units is identified to be the operation target by first identification information included in the operation instruction information acquired by the second communication control unit.

6. The air conditioner system of claim 1, wherein the first communication unit and the second communication unit are configured to communicate with the external device via a communication relay device.

7. The air conditioner system of claim 1, wherein the air conditioner system includes at least one of the first communication unit and includes at least one of the second communication unit, a quantity of the at least one of the first communication unit in the air conditioner system is less than a total quantity of the first outdoor unit and the plurality of first indoor units with which the at least one of the first communication unit communicates, and a quantity of the at least one of the second communication unit in the air conditioner system is less than a total quantity of the second outdoor unit and the plurality of second indoor units with which the at least one of the second communication unit communicates.

8. A control method for an air conditioner system having a plurality of air conditioners in each of which an outdoor unit and a plurality of indoor units connected with each other via a communication line, the plurality of air conditioners including a first air conditioner having a plurality of first indoor units and a second air conditioner having a plurality of second indoor units, the control method comprising:

in the first air conditioner, a first communication step of communicating with an external device, a first outdoor unit, and one first indoor unit of the plurality of first indoor units via a first communication unit; and a first communication control step of:

associating, as information for identifying each of the first outdoor unit and the plurality of first indoor units, first identification information uniquely set to each of the first outdoor unit and the plurality of first indoor units with second identification information uniquely set to the first communication unit, as associated information; and transmitting the associated information from the first outdoor unit or the one first indoor unit that communicates with the first communication unit, to the external device via the first communication unit, the control method further comprising:

in the second air conditioner, a second communication step of communicating with the external device, a second outdoor unit, and one second indoor unit of the plurality of second indoor units via a second communication unit; and a second communication control step of:

associating, as information for identifying each of the second outdoor unit and the plurality of second indoor units, first identification information uniquely set to each of the second outdoor unit and the plurality of second indoor units with second identification information uniquely set to the second communication unit as associated information, and transmitting the associated information from the second outdoor unit or the one second indoor unit that communicates with the second communication unit, to the external device via the second communication unit, wherein the first identification information in the first air conditioner and the first identification information in the second air conditioner are allowed to include same first identification information, and the second identification information in the first air conditioner and the second identification information in the second air conditioner are different.

9. The control method of claim 8, wherein the first communication control step includes:

associating information stored by each of the first outdoor unit and the plurality of first indoor units with first identification information of a respective one of the first outdoor unit and the plurality of first indoor units and second identification information as the associated information; and transmitting the associated information from the first outdoor unit and the one first indoor unit that communicates with the first communication unit, to the external device via the first communication unit, and wherein the second communication control step includes:

associating information stored by each of the second outdoor unit and the plurality of second indoor units with first identification information of a respective one of the second outdoor unit and the plurality of second indoor units and second identification information as the associated information, and transmitting the associated information from the first outdoor unit and the one first indoor unit that communicates with the second communication unit, to the external device via the second communication unit.

10. The control method of claim 9, wherein the information stored by each of the outdoor unit and the plurality of indoor units includes information regarding a state of a respective one of the outdoor unit and the plurality of indoor units.

11. The control method of claim 8, wherein, in the first air conditioner, the first communication control step is performed in a first device among the first outdoor unit and the plurality of first indoor units that communicates with the external device via the first communication unit, wherein the first device that communicates with the external device performs:

acquiring from each of other first devices among the first outdoor unit and the plurality of first indoor units other than the first device, information stored by a respective one of other first devices as acquired information;

associating the acquired information with first identification information of the respective one of the other first devices as the associated information; and storing the associated information, and in the second air conditioner, the second communication control step is performed in a second device among the second outdoor unit and the plurality of second indoor units that communicates with the external device via the second communication unit, wherein the second device that communicates with the external device performs:

acquiring from each of other second devices among the second outdoor unit and the plurality of second indoor units other than the second device, information stored by a respective one of the other second devices, associating the acquired information with first identification information of the respective one of the other second devices as the associated information, and storing the associated information.

12. The control method of claim 8, wherein the first communication control step includes acquiring from the external device via the first communication unit, operation instruction information in which operation details and first identification information of an indoor unit to be an operation target among the plurality of first indoor units are associated with second identification information, and each of the plurality of first indoor units controls operation based on the operation details included in the operation instruction information, when the one first indoor unit is identified to be the operation target by first identification information included in the operation instruction information acquired by the first communication control step, and wherein the second communication control step includes acquiring from the external device via the second communication unit, operation instruction information in which operation details and first identification information of an indoor unit to be an operation target among the plurality of second indoor units are associated with second identification information, and each of the plurality of second indoor units controls operation based on the operation details included in the operation instruction information, when the one second indoor unit is identified to be the operation target by first identification information included in the operation instruction information acquired by the second communication control step.

13. The control method of claim 8, wherein the first communication unit and the second communication unit perform communicating with the external device via a communication relay device.

14. The control method of claim 8, wherein the air conditioner system includes at least one of the first communication unit and includes at least one of the second communication unit, a quantity of the at least one of the first communication unit in the air conditioner system is less than a total quantity of the first outdoor unit and the plurality of first indoor units with which the at least one of the first communication unit communicates, and a quantity of the at least one of the second communication unit in the air conditioner system is less than a total quantity of the second outdoor unit and the plurality of second indoor units with which the at least one of the second communication unit communicates.

* * * * *